US007066072B2

(12) United States Patent
Boyer, Jr. et al.

(10) Patent No.: US 7,066,072 B2
(45) Date of Patent: Jun. 27, 2006

(54) DETERMINING COOK-OFF TIME OF WEAPON

(76) Inventors: Charles T. Boyer, Jr., 11321 Dixie Dr., King George, VA (US) 22485; Michael K. Oetjen, 6153 Franconia Station La., Alexandria, VA (US) 22310; Din-chih Hwang, 418 Greenbrier Ct., Fredericksburg, VA (US) 22401; Robert V. Krueger, 10286 Tetotum Rd., King George, VA (US) 22485; Raymond D. Cooper, P.O. Box 344, Bowling Green, VA (US) 22427

( * ) Notice: Subject to any disclaimer, the term of this patent is extended or adjusted under 35 U.S.C. 154(b) by 196 days.

(21) Appl. No.: 10/895,473

(22) Filed: Jul. 16, 2004

(65) Prior Publication Data

US 2006/0027086 A1 Feb. 9, 2006

(51) Int. Cl.
*F41A 17/00* (2006.01)

(52) U.S. Cl. ..... 89/1.1; 89/9; 89/27.12; 42/1.01; 42/1.05; 42/69.01; 340/584

(58) Field of Classification Search ..... 89/1.1, 89/9
See application file for complete search history.

(56) References Cited

U.S. PATENT DOCUMENTS 3,727,513 A 4/1973 Wicks ..... 89/14 A
3,902,368 A * 9/1975 Hasenbein et al. ..... 73/167
3,921,499 A 11/1975 Ginsky ..... 89/12
3,997,096 A 12/1976 Gloor et al. ..... 227/10
4,193,335 A 3/1980 Tassie ..... 89/7
4,301,709 A 11/1981 Bohorquez et al. ..... 89/11
4,702,027 A 10/1987 Stanley ..... 42/76.02
5,117,734 A 6/1992 Rhoads ..... 89/14.1
6,121,882 A * 9/2000 Jaul et al. ..... 340/584
6,502,514 B1 1/2003 Holler ..... 102/470
2002/0196152 A1 * 12/2002 Wilson et al. ..... 340/584

* cited by examiner

*Primary Examiner*—Michael J. Carone
*Assistant Examiner*—Susan C. Alimenti
(74) *Attorney, Agent, or Firm*—Gerhard W. Thielman, Esq.; Scott R. Boalick, Esq.; Marguerite O. Dineen, Esq.

(57) ABSTRACT

Determining cook-off time for a weapon is disclosed. A method determines a first barrel temperature next to a first energetic, such as a propellant charge, of ammunition within a gun barrel, and determines a second barrel temperature next to a second energetic, such as an explosive charge, of the ammunition. If the ammunition did not properly fire, the method determines a first cook-off time of the first energetic based on the first temperature next to the first energetic and the first energetic's type, and a second cook-off time of the second energetic based on the second temperature next to the second energetic and the second energetic's type. The first and second times may be determined by using one or more finite-difference heat transfer models. If either or both of the first and second times are less than a threshold, a warning-related action is performed to users of the weapon.

10 Claims, 4 Drawing Sheets

DETERMINING COOK-OFF TIME OF WEAPON

FIELD OF THE INVENTION

The present invention relates generally to weapons, such as those that have gun barrels from which ammunition is fired, and more particularly to determining the cook-off time of ammunition in such weapons.

BACKGROUND OF THE INVENTION

Military personnel and other users employ a wide variety of different weapon systems. Many weapon systems include weapons that have a gun barrel. Ammunition is fired from the gun barrel. Ideally, when the decision is made to fire ammunition from the gun barrel of a weapon, the ammunition properly fires, and exits the gun barrel towards its target. However, occasionally ammunition remains in the gun barrel of a weapon after a failed firing. In hostile environments, it is important to clear the failed ammunition from the gun barrel as quickly as possibly, so that new ammunition can be fired from the gun barrel. Until the failed ammunition can be cleared from the gun barrel of a weapon, the weapon is usually unusable.

A safety concern involved with clearing failed ammunition from the gun barrel of a weapon is that the ammunition may go off, explode, or otherwise what is referred to generally as "cook off" within the gun barrel. If personnel are near the gun barrel of a weapon, or in the case of a large gun barrel, have their hands in the gun barrel of the weapon, the personnel can become injured or die when cook off occurs. Therefore, knowing when or if failed ammunition will cook off is important.

Determining whether or if cook off of failed ammunition will occur within a gun barrel is difficult to accomplish, however. Many times a predetermined length of time is waited for all failed ammunition to possibly cook off in the gun barrel of a weapon, even if the likelihood that cook off may occur is infrequent at best. Waiting for all failed ammunition to cook off, however, means that any time ammunition fails to properly fire from the barrel of a weapon, the weapon is unusable for this length of time while personnel wait to see if cook off occurs.

For these and other reasons, therefore, there is a need for the present invention.

SUMMARY OF THE INVENTION

The invention relates to determining cook-off time for a weapon. A method of an embodiment of the invention includes determining a first barrel temperature next to a first energetic, such as a propellant charge, of ammunition within a gun barrel, as well as determining a second barrel temperature next to a second energetic, such as an explosive charge, of the ammunition. In response to receiving indication that the ammunition did not properly fire, the method determines a first cook-off time of the first energetic based on the first barrel temperature next to the first energetic and the type of the first energetic. The method also determines a second cook-off time of the second energetic based on the second barrel temperature next to the second energetic and the type of the second energetic. The first and second cook-off times may be determined by using one or more finite-difference heat transfer models, as well as other types of models. If either the first cook-off time, the second cook-off time, or both cook-off times are less than a predetermined threshold, then a warning-related action is communicated to users of the weapon.

A cook-off-warning system for a weapon having a barrel from which ammunition is fired, of another embodiment of the invention, includes a communication mechanism, a first modeling mechanism, a second modeling mechanism, a first table, a second table, and a look-up mechanism. The communication mechanism communicates with a gun control system of the weapon, and receives from the gun control system indication as to whether or not the ammunition did not properly fire. The first modeling mechanism predicts a first barrel temperature next to a first energetic of the ammunition, based on a number of rounds fired from the weapon and subsequent periods of cooling down of the weapon between the rounds fired. Furthermore, the second modeling mechanism predicts a second barrel temperature next to a second energetic of the ammunition, based on the number of rounds fired from the weapon and the subsequent periods of cooling down of the weapon between the rounds fired.

The first table stores cook-off times for the first energetic organized by temperature and type of the first energetic, and the second table stores cook-off times for the second energetic organized by temperature and type of the second energetic. The look-up mechanism looks up a first cook-off time for the fist energetic within the first table based on the type and the first temperature of the first energetic, and looks up a second cook-off time of the second energetic within the second table based on the type and the second temperature of the second energetic.

A weapon system of an embodiment of the invention includes a weapon, a gun control sub-system, and a cook-off warning sub-system. The weapon has a barrel from which ammunition is fired, and the ammunition has a first energetic and a second energetic. The gun control sub-system controls firing of the ammunition from the barrel of the weapon and monitors whether the ammunition properly fired from the barrel. The cook-off warning sub-system determines cook-off times of the first and the second energetics when the ammunition does not properly fire from the barrel, based on predicted barrel temperatures next to the first and the second energetics.

A computer-readable medium of an embodiment of the invention has a computer program stored thereon. The program includes means for predicting a first barrel temperature next to a first energetic of ammunition within a gun barrel of a weapon and for predicting a second barrel temperature next to a second energetic of the ammunition within the gun barrel of the weapon. The program also includes means for looking up a first cook-off time of the first energetic within a first table based on the first temperature and a type of the first energetic, and for looking up a second cook-off time of the second energetic within a second table based on the second temperature and a type of the second energetic. The program further includes means for causing a warning-related action to be performed for users of the weapon where at least one of the first cook-off time and the second cook-off time is less than a predetermined threshold.

Embodiments of the invention provide for advantages over the prior art. Embodiments of the invention warn that cook-off of failed ammunition within a barrel of a weapon is imminent only if cook-off time is likely to occur less than a predetermined threshold length of time. The threshold length of time may be the upper limit length of time that it will take for personnel to remove the failed ammunition from the barrel. If cook-off is not likely to occur during this length of time, then embodiments of the invention permit the personnel to remove the failed ammunition, and the personnel know that they can safely work near or in the barrel to do so. Embodiments of the invention determine cook-off time for each of the two different energetics that are present within ammunition, such as a propellant charge to propel the ammunition to its target, and an explosive charge to inflict maximum damage on the target.

Still other aspects, advantages, and embodiments of the invention will become apparent by reading the detailed description that follows, and by referring to the accompanying drawings.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

DETAILED DESCRIPTION OF THE DRAWINGS

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
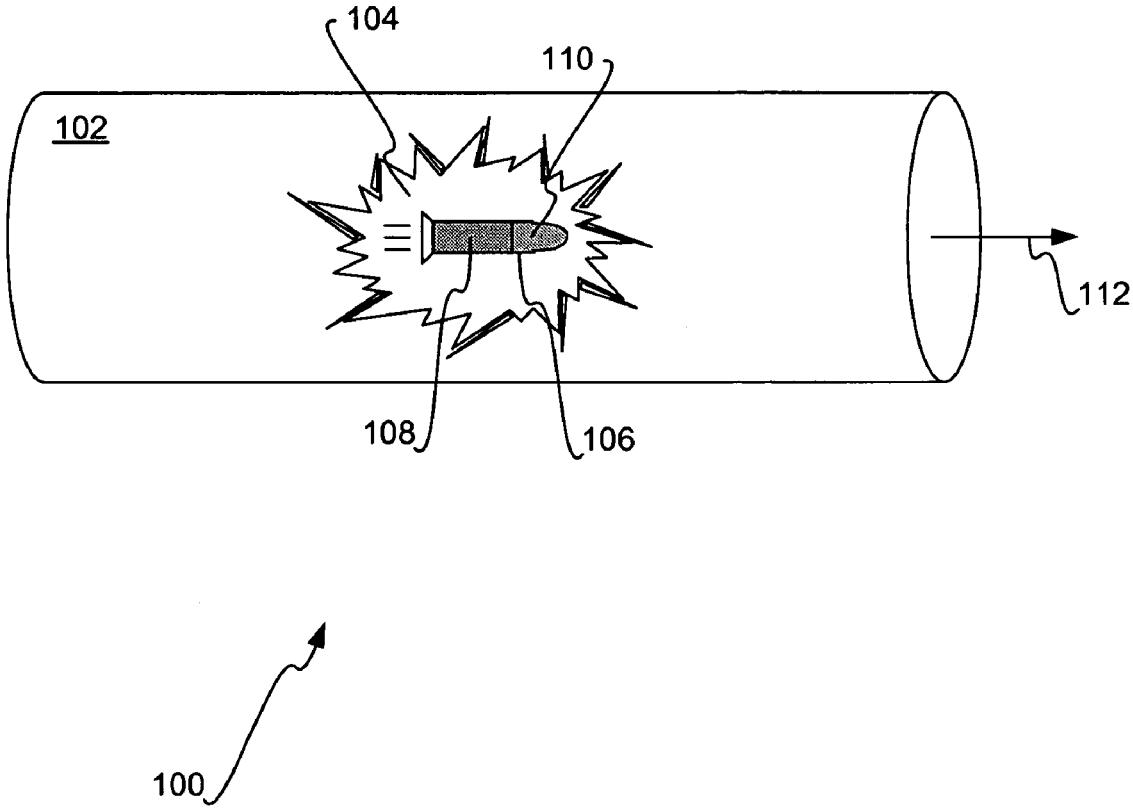
FIG. 1 is a rudimentary diagram of a representative weapon having a gun barrel, in conjunction with which embodiments of the invention may be practiced.

FIG. 1 shows a rudimentary diagram of a representative weapon 100, in conjunction with which embodiments of the invention may be practiced. The weapon 100 may be a large weapon, such as an artillery weapon mounted on a ship or a mobile or fixed unit, or a small weapon, such as a hand-carried or shoulder-carried weapon. The weapon 100 includes a gun barrel 102. Ammunition 106 is fired from within the gun barrel 102 out the end of the gun barrel 102, as indicated by the arrow 1112. The ammunition 106 is depicted in a cutout 104 of the gun barrel 102 for illustrative clarity only.

The ammunition 106 can include at least two energetics, a first energetic 108 and a second energetic 110. The first energetic 108 may be a propellant charge that forcefully causes and directs the ammunition 106 out of the end of the gun barrel 102 and towards a desired target, as indicated by the arrow 112. The second energetic may be an explosive charge that is meant to explode upon impact on the target, to cause maximum damage to the target. The ammunition 106 may include other types of energetics, in addition to and/or in lieu of those described in relation to FIG. 1.

Figure 2:
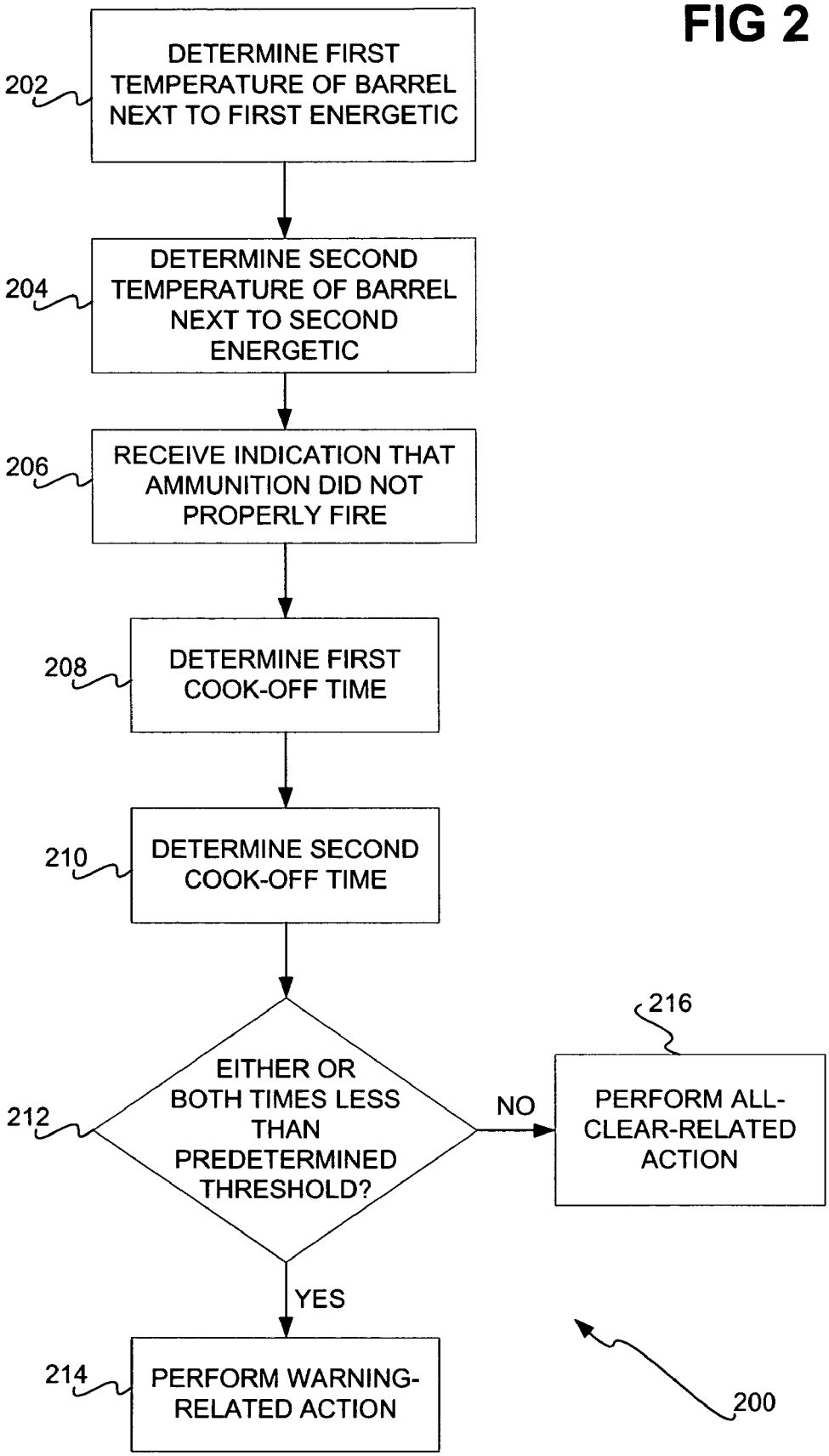
FIG. 2 is a flowchart of a method for determining cook-off time of failed ammunition within a gun barrel of a weapon, according to an embodiment of the invention.

FIG. 2 shows a method 200 for determining whether cook-off of the ammunition 106 is likely to occur where the ammunition 106 does not properly fire from the gun barrel 102 of the weapon 100, and instead remains lodged within the barrel 102, according to an embodiment of the invention. In one embodiment of the invention, at least some parts of the method 200 are implemented as a computer program stored on a computer-readable medium. The computer-readable medium may be a recordable data storage medium, a modulated carrier signal, or another type of medium.

The method 200 first determines a first barrel temperature next to the first energetic 108 (202), and a second barrel temperature next to the second energetic 110 (204). The barrel temperature next to the first energetic 108 is referred to as the first temperature and the barrel temperature next to the second energetic 110 is referred to as the second barrel temperature simply to distinguish the barrel temperature next to the first energetic 108 from the barrel temperature next to the second energetic 110. That is, there is no other reason in calling the barrel temperature next to the first energetic 108 the first temperature and the barrel temperature next to the second energetic 110 the second temperature.

Both the first temperature and the second temperature may be determined by predicting these temperatures. For instance, a model may be utilized that determines the first barrel temperature next to the first energetic 108 based on the number of rounds that have been fired from the weapon 100, and the periods of cooling down of the weapon 100 between the rounds fired. Similarly, the same or different model may be utilized to determine the second barrel temperature next to the second energetic 110 based on the number of rounds that have been fired from the weapon 100, and the periods of cooling down of the weapon 100 between the rounds fired. The type of model employed may be a finite-difference heat transfer model, as can be appreciated by those of ordinary skill within the art.

The finite-difference heat transfer model may be constructed based on empirical observations made relative to the particular type of weapon 100 used, such as including the particular type of gun barrel 102 of the weapon, as well as the particular type of ammunition 106 employed, including the particular type of the first energetic 108 and the particular type of the second energetic 110. The empirical data may include recording the barrel temperatures next to the first energetic 108 and the second energetic 110, the number of rounds that have been fired since the gun barrel 102 was at an ambient temperature (i.e., since the barrel 102 was "cold"), and the lengths of time of the periods of cooling down of the barrel 102 between the rounds fired. Based on such empirical data, finite-difference heat transfer models can then be constructed for the gun barrel next to the first energetic 108 and the second energetic 110, as can be appreciated by those of ordinary skill within the art.

If the ammunition 106 did not properly fire from the gun barrel 102 of the weapon 100, then the method 200 receives indication that this event occurred (206). For instance, the method 200 may receive such indication from the gun control system for the weapon 100, as particularly described later in the detailed description. In response, the method 200 determines the first cook-off time of the first energetic 108 (208), and the second cook-off time of the second energetic 110 (210). As with the terminology first temperature and second temperature, the cook-off time of the first energetic 108 is referred to as the first cook-off time and the cook-off time of the second energetic 110 is referred to as the second cook-off time simply to distinguish the cook-off time of the first energetic 108 from the cook-off time of the second energetic 110. The terminology cook-off time is generally defined as the length of time after failed firing of ammunition before the failed ammunition will cook off (viz., explode, ignite, go off, etc.) within a gun barrel of a weapon undesirably.

Determining the first and the second cook-off times may be accomplished by looking up these times in one or more look-up tables organized by type of ammunition and barrel temperature. For instance, the first cook-off time of the first energetic 108 may be determined by looking up the first cook-off time in a look-up table that stores such cook-off times by the type of the first energetic 108, and by the first barrel temperature next to the first energetic 108 that has been predicted. Similarly, the second cook-off time of the second energetic 110 may be determined by looking up the second cook-off time in the same or a different look-up table that stores such cook-off times by the type of the second energetic 110, and by the second barrel temperature next to the second energetic 110 that has been predicted. As with the heat-transfer models, such look-up tables may be constructed by empirical observation and data recordation, so that the tables are accurately built.

If either or both of the cook-off times are less than a predetermined threshold (212), then a warning-related action is performed (214). Otherwise, an all-clear-related action is performed (216). The predetermined threshold may be ten minutes, or another length of time, such as the maximum length of time it will likely take for personnel to remove the failed ammunition 106 from the gun barrel 102 of the weapon 100. The warning-related action performed to users of the weapon 100 may be a light, sound, or another type of action, and indicates to the users that they should not attempt to enter and/or be near the barrel 102, due to the likelihood that cook off will occur within the threshold length of time. The all-clear-related action performed to users may also be a light, sound, or another type of action, and indicates to the users that they have at least the threshold length of time to remove the failed ammunition 106 from the barrel 102.

Figure 3:
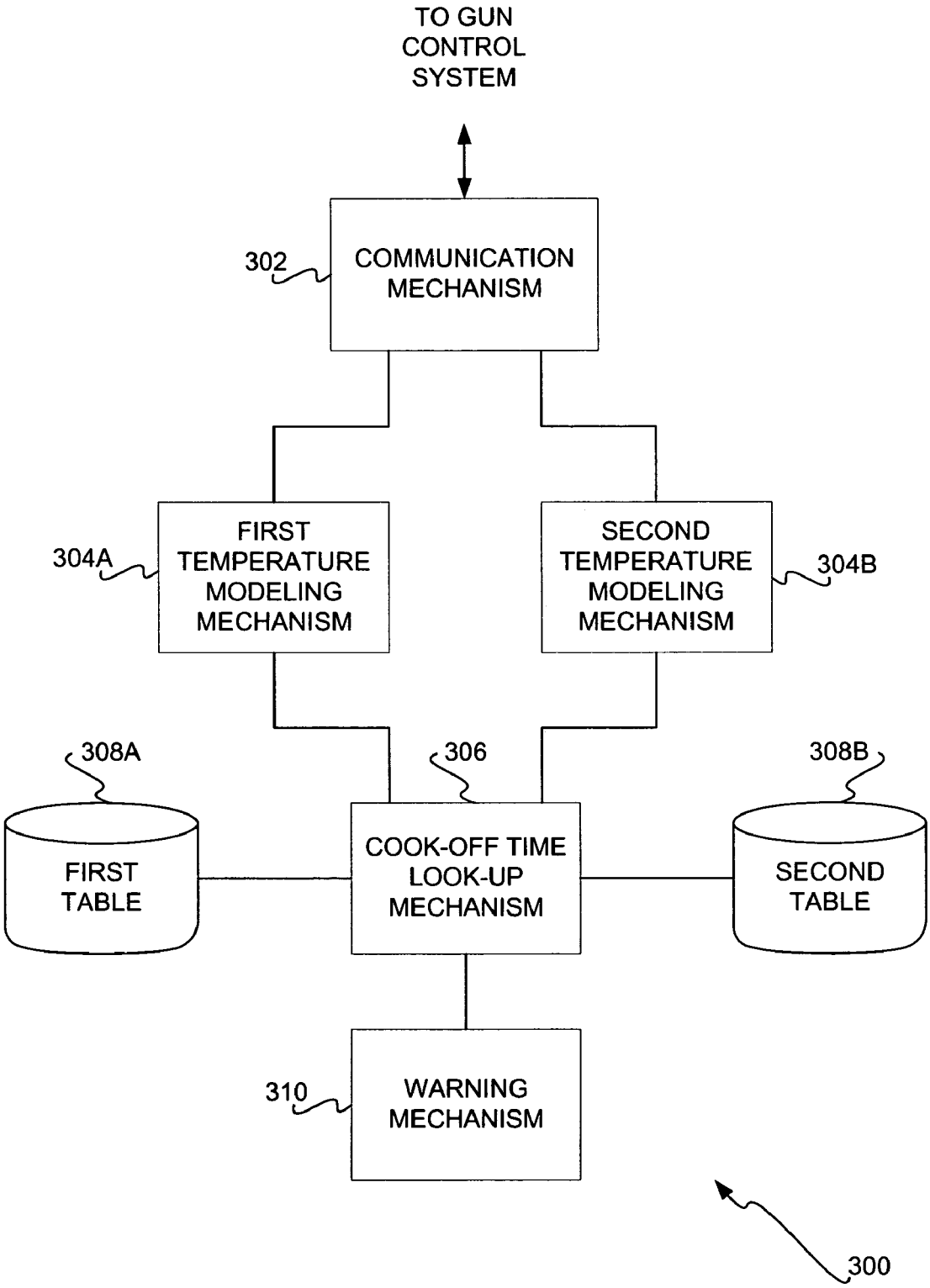
FIG. 3 is a diagram of a cook-off warning system or sub-system for a weapon that has a barrel from which ammunition is fired, according to an embodiment of the invention.

FIG. 3 shows a cook-off warning system 300 for the weapon 100, according to an embodiment of the invention. The cook-off warning system 300 may also be referred to as a cook-off warning sub-system. The cook-off warning system 300 includes a communication mechanism 302, a first temperature modeling mechanism 304A, and a second temperature modeling mechanism 304B, the latter two mechanisms collectively referred to as the temperature modeling mechanisms 304. The cook-off warning system 300 further includes a cook-off time look-up mechanism 306, a first table 308A, and a second table 308B, the latter two tables collectively referred to as the tables 308. The cook-off warning system 300 also includes a warning mechanism 310.

The mechanisms 302, 304, 306, and 310 of the cook-off warning system 300 may each be implemented in hardware, software, or a combination of hardware and software. Furthermore, in one embodiment, the temperature modeling mechanisms 304 may be implemented as a single mechanism instead of two temperature modeling mechanisms 304A and 304B. The tables 308 may be stored on a computer-readable medium, such as volatile or non-volatile memory, magnetic storage media, and so on. The tables 308 may in one embodiment be implemented as a single table instead of two tables 308A and 308B. The cook-off warning system 300 may perform the method 200 of FIG. 2 that has been described.

The communication mechanism 302 of the cook-off warning system 300 communicates with a gun control system or sub-system for the weapon 100. The gun control system controls firing of the ammunition 106 from the gun barrel 102 of the weapon 100, as can be appreciated by those of ordinary skill within the art. The gun control system records the number of rounds fired since the weapon 100 was at ambient temperature, or "cold," as well as the lengths of the periods of time between rounds fired. The gun control system also detects whether the ammunition 106 did not properly fire from the barrel 102, such that it remains in the barrel 102 after firing. The communication mechanism 302 receives all of this information from the gun control system in one embodiment of the invention.

In response to the communication mechanism 302 receiving indication that the ammunition 106 did not properly fire from the gun barrel 102, the temperature modeling mechanisms 304 of the cook-off warning system 300 predicts the barrel temperatures next to the energetics 108 and 110, as has been described in relation to the method 200 of FIG. 2. The first temperature modeling mechanism 304A specifically predicts the barrel temperature next to the first energetic 108, whereas the second temperature modeling mechanism 304B specifically predicts the temperature of the second energetic 110. As has been described, the barrel temperatures next to the energetics 108 and 110 are predicted based on the number of rounds fired, and the subsequent periods of cooling down of the weapon 100 between rounds fired, information regarding which the communication mechanism 302 receives from the gun control system.

The cook-off time look-up mechanism 306 of the cook-off warning system 300 looks up the first cook-off time for the first energetic 108 within the first table 308A, and the second cook-off time for the second energetic 110 within the second table 308B. The tables 308 may themselves store the cook-off times for their associated energetics, organized by temperature and type of the energetics. The cook-off look-up mechanism 306 provides the first and the second cook-off times to the warning mechanism 310. If either or both of the cook-off times is less than a predetermined threshold, such as ten minutes, then the warning mechanism 310 warns users of the weapon that cook-off is likely to occur within the predetermined threshold length of time. Otherwise, the warning mechanism 310 may indicate to the users that cook-off is not likely to occur within the predetermined threshold length of time, as has been described.

Figure 4:
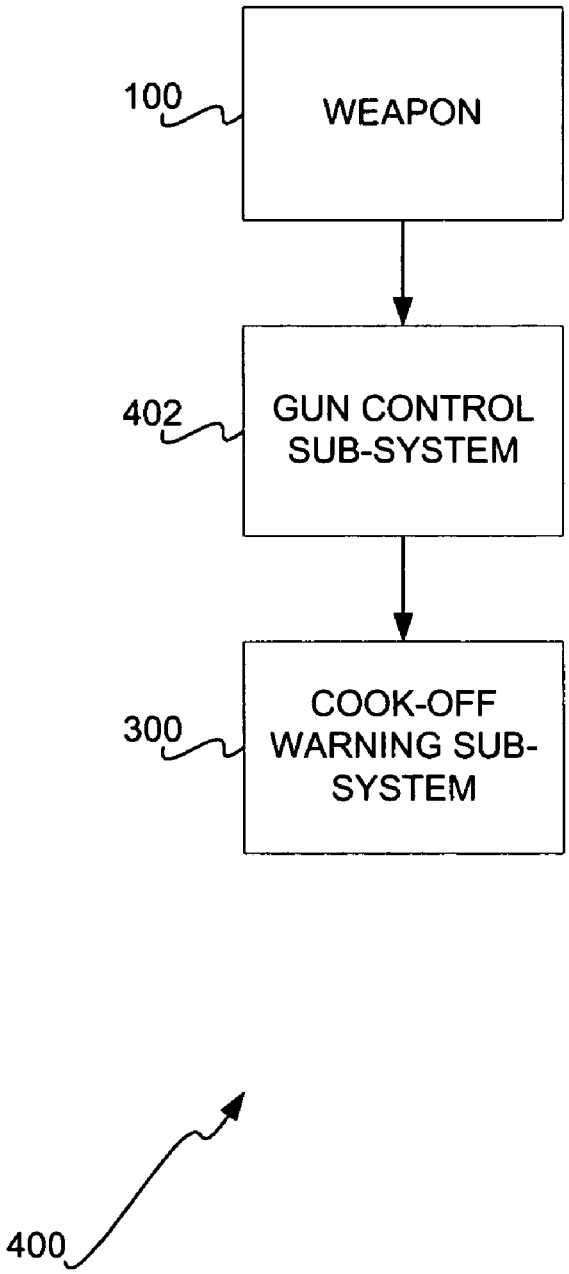
FIG. 4 is a diagram of a weapon system having a weapon, a gun control sub-system, and a cook-off warning sub-system, according to an embodiment of the invention.

FIG. 4 is a block diagram of a rudimentary weapon system 400, according to an embodiment of the invention. The weapon system 400 is depicted as including the weapon 100 that has been described, the cook-off warning sub-system 300 that has been described, and a gun control sub-system 402. As can be appreciated by those of ordinary skill within the art, the weapon system 400 may include other components, in addition to and/or in lieu of those depicted in FIG. 4, in other embodiments of the invention.

The gun control sub-system 402 is the system that controls firing of the weapon 100, and that monitors firing of the weapon 100. The gun control sub-system 402 is that which the communication mechanism 302 of the cook-off warning sub-system 300 communicates, as has been described. That is, the gun control sub-system 402 communicates with the cook-off warning sub-system 300 to indicate whether or not the ammunition 106 has properly fired from the barrel 102 of the weapon 100, and information regarding the number of rounds fired and the periods of cooling down of the weapon 100 between the rounds fired. The gun control sub-system 402 may include hardware, software, or a combination of hardware and software.

It is noted that, although specific embodiments have been illustrated and described herein, it will be appreciated by those of ordinary skill in the art that any arrangement calculated to achieve the same purpose may be substituted for the specific embodiments shown. This application is intended to cover any adaptations or variations of embodiments of the present invention. It is thus manifestly intended that this invention be limited only by the claims and equivalents.

What is claimed is:

1. A method comprising:

determining a first barrel temperature next to a first energetic of ammunition within a gun barrel of a weapon;

determining a second barrel temperature next to a second energetic of the ammunition;

in response to receiving indication that the ammunition did not properly fire, determining a first cook-off time of the first energetic based on the first barrel temperature next to the first energetic and a type of the first energetic;

determining a second cook-off time of the second energetic based on the second barrel temperature next to the second energetic and a type of the second energetic; and, where at least one of the first cook-off time and the second cook-off time is less than a predetermined threshold, performing a warning-related action to users of the weapon.

2. The method of claim 1, further comprising, otherwise, performing an all-clear-related action to the users of the weapon.

3. The method of claim 1, wherein determining the first barrel temperature next to the first energetic comprises utilizing a model to determine the first temperature based on a number of rounds fired from the weapon and subsequent periods of cooling down of the weapon between the rounds fired.

4. The method of claim 3, wherein the model is a finite-difference heat transfer model.

5. The method of claim 1, wherein determining the second barrel temperature next to the second energetic comprises utilizing a model to determine the second temperature based on a number of rounds fired from the weapon and subsequent periods of cooling down of the weapon between the rounds fired.

6. The method of claim 5, wherein the model is a finite-difference heat transfer model.

7. The method of claim 1, wherein determining the first cook-off time of the first energetic comprises looking up the first cook-off time within a table for the type of the first energetic, based on the first temperature.

8. The method of claim 1, wherein determining the second cook-off time of the second energetic comprises looking up the second cook-off time within a table for the type of the second energetic, based on the second temperature.

9. The method of claim 1, wherein the first energetic is a propellant charge to propel the ammunition from the barrel, and the second energetic is an explosive charge to cause damage upon the ammunition reaching a target.

10. The method of claim 1, wherein the predetermined threshold is ten minutes.

* * * * *